US005193712A

United States Patent [19]

Küppersbusch

[11] Patent Number: 5,193,712

[45] Date of Patent: Mar. 16, 1993

[54] STACKABLE PACKING FOR BULK MATERIAL

[76] Inventor: Gerd Küppersbusch, Siemensstr. 34-36, D-5620 Velbert 1, Fed. Rep. of Germany

[21] Appl. No.: 838,060

[22] Filed: Feb. 19, 1992

[30] Foreign Application Priority Data

Jun. 26, 1990 [DE] Fed. Rep. of Germany ..... 4020285
Jun. 21, 1991 [WO] PCT Int'l Appl. ... PCT/EP91/01149

[51] Int. Cl.[5] ..... B65D 5/60; B65D 5/74

[52] U.S. Cl. ..... 220/465; 220/403; 220/410; 229/125.15; 229/217; 229/218

[58] Field of Search ..... 220/462, 465, 403, 408, 220/410, 463; 229/217, 218, 164, 125.15

[56] References Cited

U.S. PATENT DOCUMENTS

| | | | |
|---|---|---|---|
| 2,861,718 | 11/1958 | Winzen | 220/465 |
| 2,898,027 | 8/1959 | Scholle | 220/462 |
| 2,954,901 | 10/1960 | Winstead . | |
| 3,087,655 | 4/1963 | Scholle . | |
| 3,089,622 | 5/1963 | Westlake, Jr. | 220/465 |
| 3,090,526 | 5/1963 | Hamilton et al. | 220/465 |
| 3,100,587 | 8/1963 | Cox, Jr. | 220/465 |
| 3,108,732 | 10/1963 | Curie et al. | 220/465 |
| 3,117,695 | 1/1964 | Cox, Jr. | 220/465 |
| 3,119,544 | 1/1964 | Cope et al. | 220/462 |
| 3,173,579 | 3/1965 | Curie et al. | 220/465 |
| 3,178,064 | 4/1965 | Layne | 220/465 |
| 3,206,094 | 9/1965 | Humphrey et al. | 220/462 |
| 3,233,817 | 2/1966 | Casady | 220/465 |
| 3,253,764 | 5/1966 | Goetschius et al. | 220/465 |
| 3,318,505 | 5/1967 | Garrison et al. | 220/465 |
| 3,952,940 | 4/1976 | Malcolm . | |
| 4,872,588 | 10/1989 | Texidor | 220/403 |

FOREIGN PATENT DOCUMENTS

| | | | |
|---|---|---|---|
| 0365940A1 | 5/1990 | European Pat. Off. . | |
| 0420818A1 | 4/1991 | European Pat. Off. . | |
| 3829606A1 | 3/1990 | Fed. Rep. of Germany . | |
| 2573039 | 5/1968 | France | 229/125.15 |
| 2206241 | 6/1974 | France . | |
| 2446233 | 9/1980 | France | 220/465 |

*Primary Examiner*—Gary E. Elkins
*Attorney, Agent, or Firm*—Donald Brown

[57] ABSTRACT

A stackable bulk-material packing or container is disclosed, which can have a simple opening for pouring out the contents. The packing uses a folding-box carton with a bag inside it. The bag has an opening for pouring out the contents. The opening has an annular shoulder and is located behind a removable section of the carton. Removal of this section produces an opening in the carton giving access to the opening in the bag. The removal section of the carton is located at one of the upper corners or one of the upper edges of the carton. Because the removable section of the carton and the opening in the bag are co-located at one of the upper corners or one of the upper edges of the carton, the contents do not exert any pressure on them, and the closure can thus be of a simple design.

11 Claims, 5 Drawing Sheets

STACKABLE PACKING FOR BULK MATERIAL

The invention relates to a stackable package for bulk material.

A stackable packing of the above kind is disclosed in DE 38 29 606 Al. This known packing has a slotted aperture in an upper section of a sidewall thereof and a nozzle-shaped projection of an inner bag is hung into the aperture when assembling the folding-box carton and the inner bag. Thereafter the folding-box carton is folded up and the inner bag is filled. This upper sidewall portion is disposed so as to form a horizontal upper surface when finished. The nozzle-shaped projection is firmly clamped within the aperture and can not be drawn therefrom. Further, the nozzle-shaped projection is not located right at the upper edge or at an upper corner which may impede a pouring operation.

In further known stackable packings a lower part of the folding-box carton can be removed. A pouring spout is substantially horizontally drawn out through the aperture which has been produced thereby. The pouring spout comprises a closable cock for withdrawing the liquid within the inner bag. The cock is designed such that air is prevented from entering the inner bag when withdrawing liquid. Hence, the inner bag collapses, if liquid is withdrawn. As the pouring spout and the cock are disposed in a lower region of the packing, the pressure of the liquid within the inner bag always acts upon the cock. This requires a costly mechanical design of the cock in order to ensure a reliable closure even after multiple operation. This can be hardly achieved with cocks which are manufactured from plastic in particular for cost reasons.

It is the object of the invention to provide a stackable packing for bulk material of the above described kind wherein the aforementioned problems are avoided.

This is achieved by a stackable packing for bulk material of the above described kind which is characterized by the features of claim 1.

The invention location of the removable portion of the stackable packing provides the advantage that the liquid pressure does not act upon the pouring spout which is located behind the removable portion. The pouring spout can therefore be designed in a mechanically simple manner. In use the closure or seal has to meet low requirements only. Moreover, the location of the removable portion at a corner or edge provides the advantage that a bevelled corner or edge is produced after removing the removable portion. The spout or opening for withdrawing liquid can be disposed in the space produced by the bevelled corner or edge such that it does not or hardly project beyond the outer contour of the original packing, even in the operational position thereof. In particular the packing provides the advantage that the bulk material can be poured out or emptied from the packing in a particularly easy manner after drawing out the spout. The inner bag is reliably supported at the bottom.

Preferred embodiments of the invention are characterized in the subclaims.

According to one embodiment the packing provides the advantage that the pouring spout may be left open in the drawn-out position thereof without liquid or other bulk material being allowed to escape. According to a further embodiment the packing provides the advantage that the removable portion may be easily taken off. The packing according to another embodiment provides the advantage that the space for a further pouring spout has a particularly advantageous form and the pouring operation is facilitated. The packing according to a further embodiment provides the advantage that the inner bag can easily be separated form the folding-box carton and can be disposed separately from the folding-box carton. A further embodiment provides the advantage that the pouring spout can be fixed to the inner bag in a particularly easy manner. Another embodiment provides the advantage that the drawn-out pouring spout can not fall back into the folding-box carton, but is reliably supported. The packing according to a further embodiment, however, provides the advantage that the inner bag can be removed from the folding-box carton in a particularly easy manner. Finally, another embodiment provides the advantage that the folding-box carton can be opened for removing the inner bag in a particularly easy manner.

In the following embodiments are described with reference to the figures. In the figures.

Figure 1:
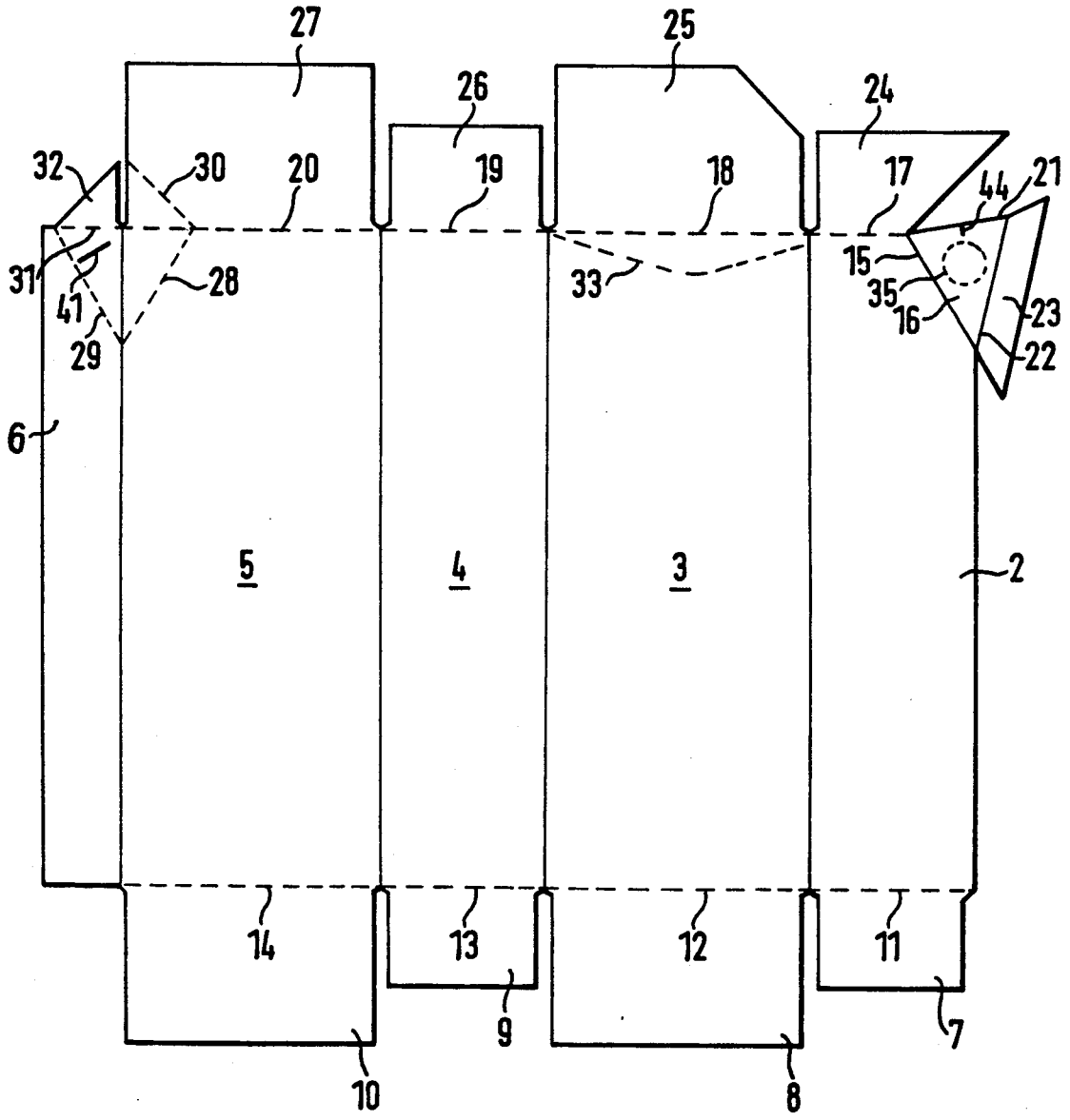
FIG. 1 shows a developed view of the cut or blank for the folding-box carton.
Figure 2:
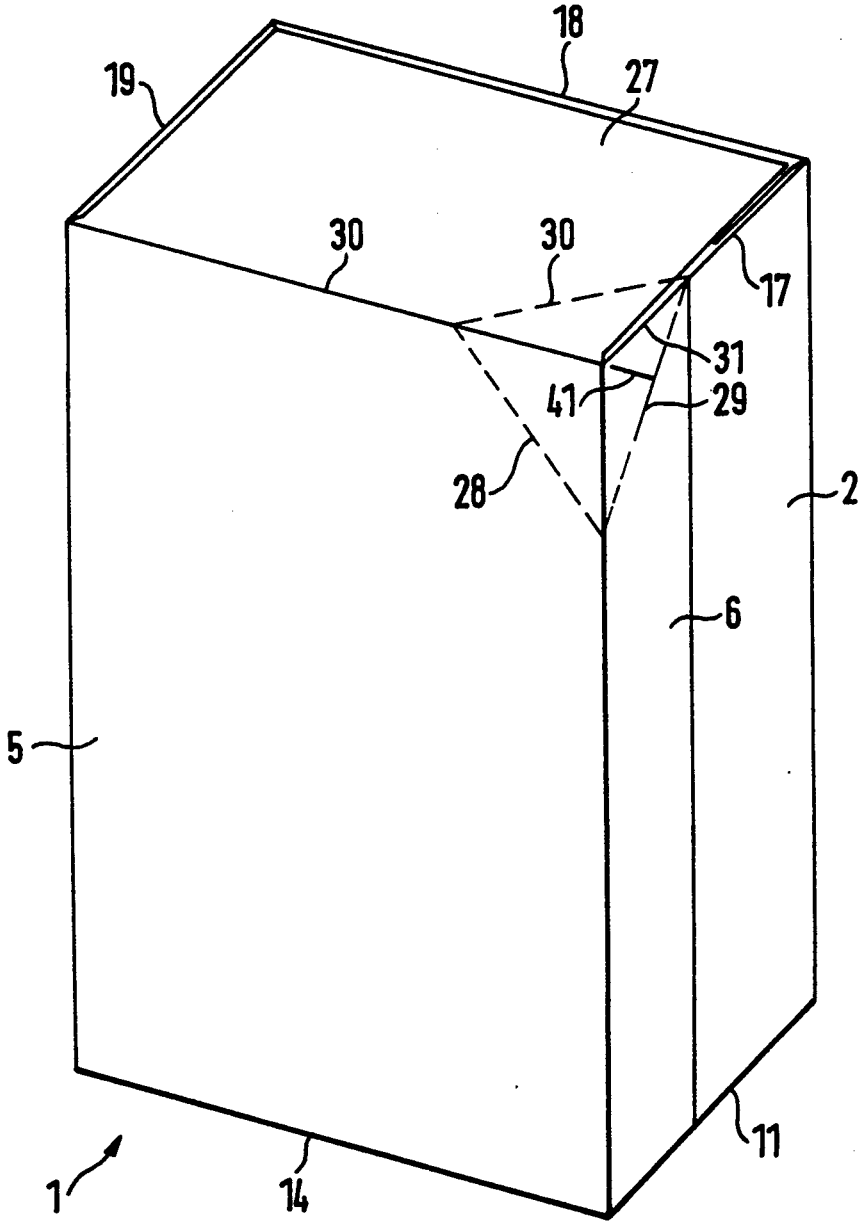
FIG. 2 is a perspective view of the packing in closed state.
Figure 3:
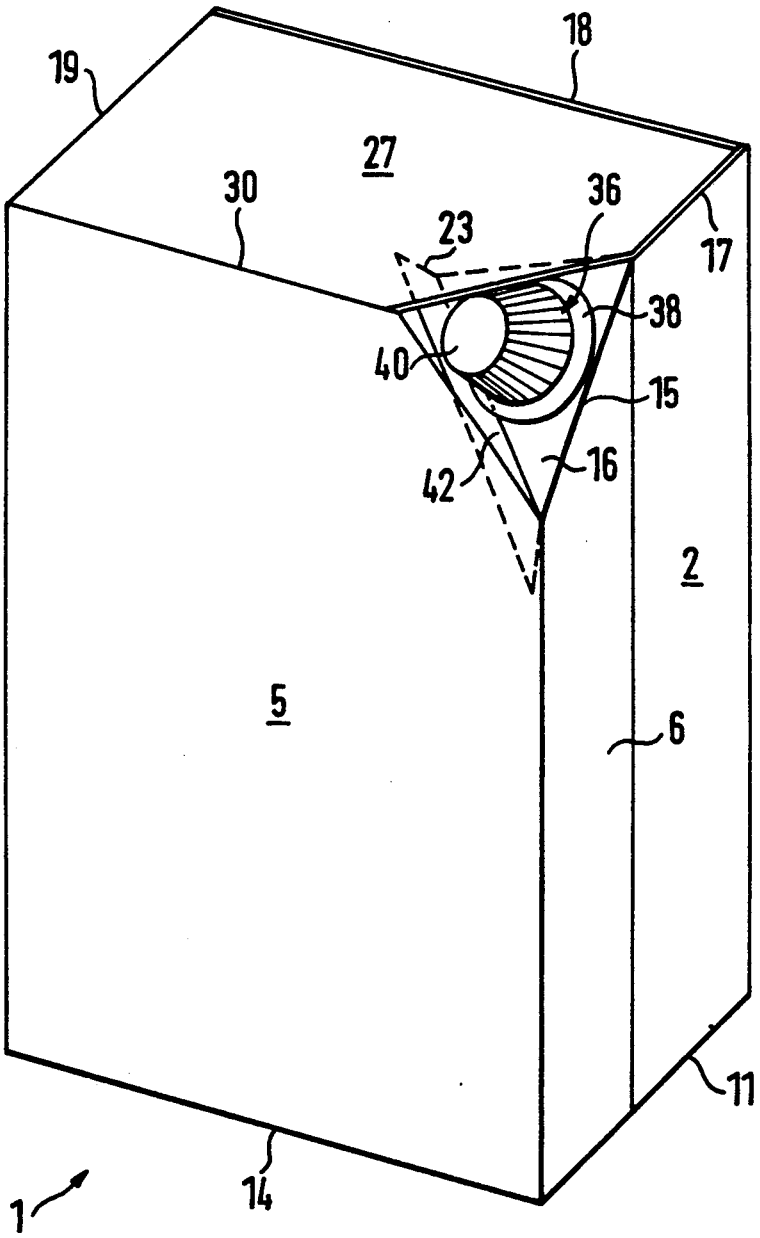
FIG. 3 is a perspective view of an embodiment of the inventive packing immediately after removing the removable portion.

As shown in FIG. 1, the cut or blank for the inventive packing 1 shows as a whole in FIG. 2 comprises a first narrow side 2, a first wide side 3, a second narrow side 4 and a second wide side 5. The first narrow side is connected at one of its longitudinal edges with a longitudinal edge of the first wide side, the first wide side has the other longitudinal edge thereof connected with a longitudinal edge of the second narrow side, the other longitudinal edge of the second narrow side is connected with a longitudinal edge of the second wide side. Finally, a flap 6 is connected with the other longitudinal edge of the second wide side. The flap 6 can be glued onto the first narrow side 2 such that the carton blank has a rectangular cross-section when viewed from the top.

Respective bottom flaps 7, 8, 9 and 10 are mounted at the bottom edges of both narrow sides and both wide sides. These bottom flaps can each be folded by 90° around the edge 11, 12, 13 or 14 connecting the same with the respective associated side such that a packing bottom is produced.

When the carton blank is closed to form the packing, the upper edges 17, 18, 19 and 20 of the first narrow and wide sides and of the second narrow and wide sides lie in a horizontal plane.

A folding line 15 is provided at the upper corner of the first narrow side 2 opposite to the first wide side 3. A triangular carton portion 16 is connected with the first narrow side 2 through the folding line 15. The triangular carton portion 16 connected with the first narrow side 2 is larger than the triangle which would be cut off by the folding line 15 from a proper rectangular narrow side 2. The upper edge 21 of the triangular carton portion 16 rises upwardly from the folding line 15. The angle defining the sloping upper edge 21 with respect to the upper edges of the narrow and wide sides is selected such that after closing the carton blank to form a rectangular body the upper edge 21 lies in the plane formed by the upper edges of the narrow and wide sides, if the triangular carton portion 16 is folded inwardly by 45°. The lateral edge 22 of the triangular portion 16 extends outwardly at an angle with respect to the lateral edge of the first narrow side. The angle of the lateral edge 22 with respect to the lateral edge of the narrow side 2 is selected such that the lateral edge 22 just touches the inner side of the second wide side 5, if the triangular carton portion 16 is folded inwardly by 45° of the closed carton blank.

In support of the triangular carton portion 16 a narrow carton flap 23 is provided at the lateral edge 22 of the triangular carton portion 16.

Thus, the triangular carton portion 16 is formed as an isosceles triangle having the upper edge 21 as basis.

A first top flap 24 is provided at the upper edge 17 of the first narrow side and this top flap can be folded inwardly around the upper edge 17 for forming a cover. The first top flap 24 is connected with the first narrow side 2 only at that region of the upper edge 17 outside of the triangular carton portion 16. A lateral edge of the first top flap 24 extends substantially along a prolongation of the connection between the first narrow side and the first wide side. The upper edge of the first top flap is substantially parallel to the upper edge 17 of the first narrow side. The other lateral edge of the first top flap 24 opposite to the line connecting the first narrow side and the first wide side is inclined outwardly by 45° such that the first top flap is of trapezoidal form. This shape of the first top flap 24 ensures that the first top flap 24 exposes an opening when forming a cover. This opening corresponds exactly to the portion which results when folding the triangular carton portion 16 inwardly by 45°.

A second top flap 25 is provided at the upper edge 18 of the first wide side 3. The second top flap 25 has a substantially rectangular form. A triangular portion has been cut off at the upper corner adjacent the connecting line between the first narrow side 2 and the first wide side 3. This cut-off triangular portion corresponds exactly to the opening which is divided off by the triangular carton portion 16 if the triangular carton portion 16 is folded inwardly by 45°.

A third top flap 26 is provided at the upper edge 19 of the second narrow side 4. The third to flap 26 has a substantially rectangular form. The height of the third top flap 26 is selected such that it does not cover the opening which is formed when folding the triangular carton portion 16 inwardly by 45°.

A fourth top flap 22 is formed at the upper edge 20 of the second wide side 5. The fourth top flap 22 is substantially rectangular. The lateral edges of the fourth top flap 27 substantially form a prolongation of the lateral edges of the second wide side 5. The height of the fourth top flap 27 is preferably selected int he same manner as the height of the second top flap 25 such that in the folded-over position the second top flap 25 substantially extends up to the second wide side 5 and the fourth top flap extends int he folded-over position thereof substantially up to the first wide side 3.

A first perforation line 28 is formed at the upper corner of the second wide side 5 opposite to the second narrow side 4. This first perforation line 28 divides off a triangle from the upper corner of the second wide side 5. This triangle corresponds exactly to the triangle which the folding line 15 would divide off from the first narrow side 2, if the first narrow side 2 had a rectangular shape, i.e. if the edges of the triangular carton portion 16 would not be inclined with respect to the lateral edges of the first narrow side 2. Thus, the first perforation line 28 is exactly symmetrical to the folding line 15 with respect to the connection line between the first wide side 3 and the second narrow side 4.

A second perforation line 29 which is symmetric to the first perforation line 28 with respect to the connection line between the second wide side 5 and the flap 6 is formed in the flap 6. A third perforation line 30 is formed symmetric to the first perforation lien 28 with respect to the upper edge 20 of the second narrow side 5. A triangular reinforcement portion 32 is connected with the upper edge of the flap 6 through a fourth perforation line 31. The reinforcement portion 32 corresponds substantially to the triangle which is divided off in the fourth top flap 27 by the third perforation line 30.

A tear-off perforation line 33 is formed int he first wide side 3 close to the upper edge 18. The tear-off perforation line 33 is arranged to form in cooperation with the upper edge 18 of the first wide side 3 a flat isosceles triangle where the upper edge 18 forms the basis.

The inventive packing is assembled as follows. A flat film 34 (see FIG. 5) is placed onto the inner side of the carton blank described with reference to FIG. 1. A hole 35 is stamped through the triangular carton portion 16 and the film 34. A pouring spout 36 having a nozzle-shaped projection 37 and a flange 38 as well as a heated annular pressing-piece 39 is inserted through the hole 35 and deformed by means of correspondingly shaped pressing tools such that a positive, tight and torsion-proof connection is produced. Following the pressing operation a cap 40 is placed onto the projection 37 in a fluid-tight manner.

The plane film 34 is doubled parallel to the longitudinal axis and the two ends of the film are sealed or welded to form a tight longitudinal seam. The thus produced flat film tube is provided with a head seam at the upper end thereof. To this end, the two folding lines of the film tube are displaced such that the head seam extends parallel to the wide sides of the packing in the later erected position of the produced inner bag.

By means of opposite vacuum suction apparatus the flat film tube is erected and slipped over a form die. During the slipping movement the inner side of the carton blank is moved past glue nozzled of applying glue to the flap 6, the bottom flaps 7, 8, 9 and 10 and the first to fourth top flaps 24, 25, 26 and 27. After the slipping movement has been terminated the carton sides projecting form the form die are folded over one after another and pressed onto each other by means of folding members. This produces a firm cuboid carton sleeve around the form die, wherein the first and second narrow sides and the first and second wide sides form the side faces, the bottom flaps form the bottom face and the top flaps form the top cover. The form die has a recess located in the region of the triangular carton portion 16 to allow the triangular carton portion 16 and the pouring spout 36 to yield inwardly.

The packing with finished top region is drawn off form the form die and turned 180° such that it can be taken over by a filling an closing machine. The packing is filled and the inner bag is sealed or welded int he bottom region thereof by a longitudinal seam which is parallel to the wide sides. First a bottom flap 8 or 10 at one of the two wide sides is folded over by 90°. Thereafter the ears of the inner film bag which have been obtained by the longitudinal seam are placed inwardly. Then the two bottom flaps 7 and 9 at the narrow sides 2 and 4 are folded inwardly and finally the other of the two bottom flaps at the wide sides is folded over. The two ears of the inner bag are thereby placed between the dust and glue flaps of the carton bottom, whereby the inner bag is suitably anchored.

In this manner the finished packing shown in FIG. 2 is produced which faces the consumer in the form shown in FIG. 2.

Figure 4:
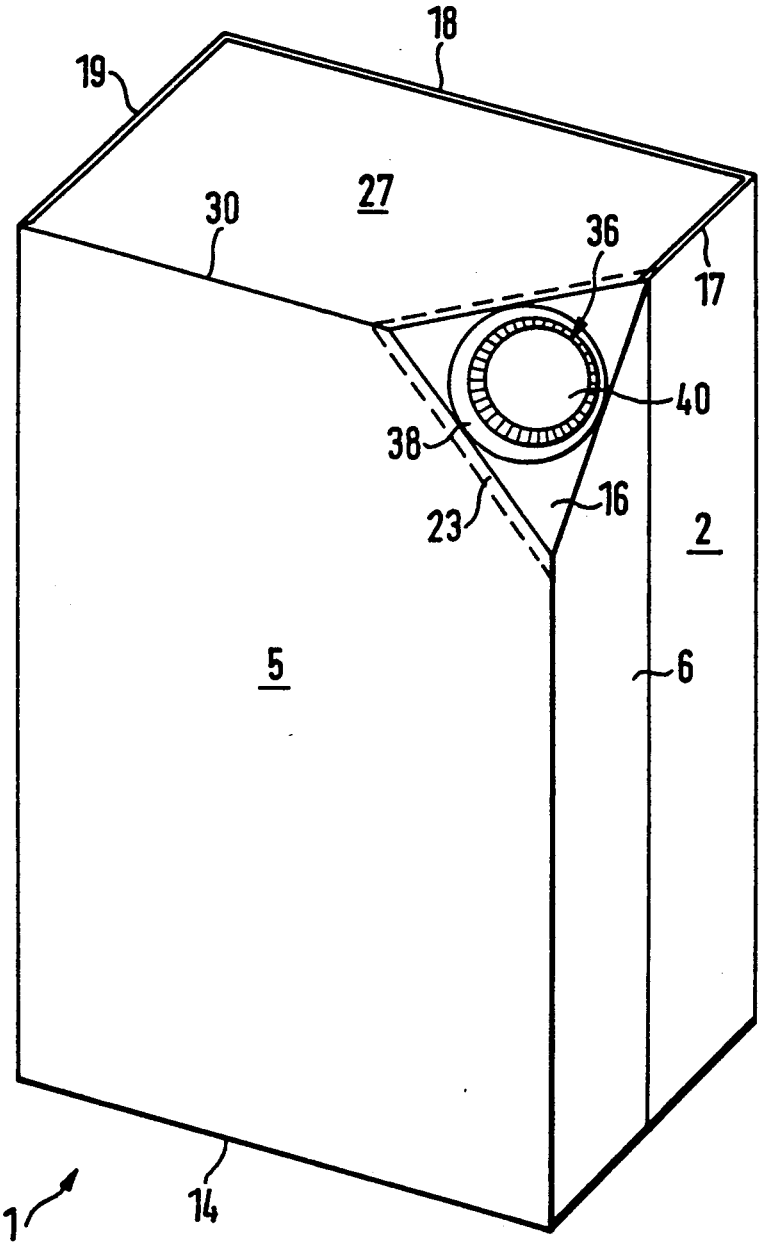
FIG. 4 is a perspective view of the embodiment of FIG. 3 after pulling out the pouring spout.

For use the consumer open the first, second and third perforation lien 28, 29 and 30 and eventually also the fourth perforation line 31. This is facilitated by an auxiliary cut 31 in the flap 6 within the triangle divided off by the second perforation line 29. When the first, second and third perforation line 28, 29 and 30 are teared through, a pyramidal cap having its base lines defined by the first, second an third perforation lines 28, 29 and 30 may be removed. Behind the thus generated opening 42 the pouring spout 36 may be accessed. During manufacture the pouring spout was kept safe within the interior of the packing. Now the consumer grasps the pouring spout 36 and pulls the same out of the opening 42. In the course of this the triangular carton portion 16 folds around the folding line 15 until the lateral edge 22 of the triangular carton portion 16 abuts the second sidewall 5. Thus, the narrow carton flap 23 of the triangular carton portion 16 lies flat against the second wide side 5. The state shown in FIG. 4 is thereby obtained.

Figure 5:
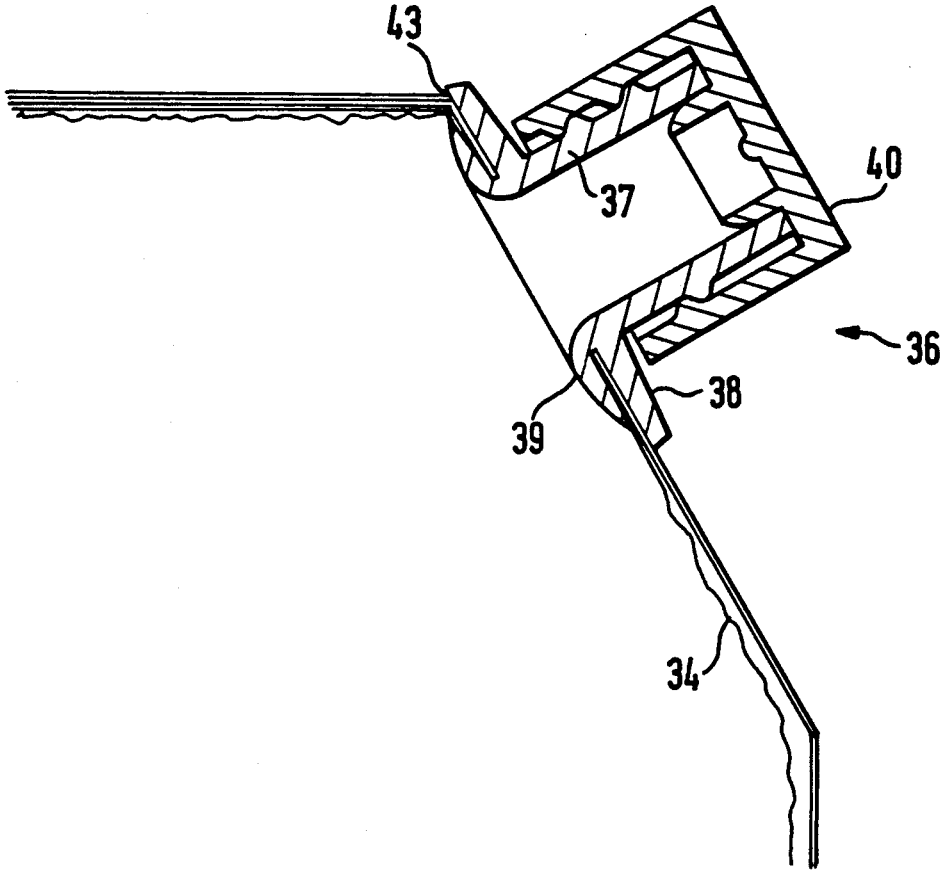
FIG. 5 shows a cross-section of a pouring spout in pulled-out state.

The triangular carton portion 16 exactly covers the opening 42, the flange 38 of the pouring spout 36 is pulled out to such an extend that a projection portion 43 of the flange 38 locks behind the edge at the top side 27 or the edge at the wide side 5 such that the pouring spout is prevented from slipping back into the packing (cf. FIG. 5). Now the cap 40 or any other closure of the pouring spout 36 can be removed without difficulties and the bulk material within the inner bag can be poured out. Since the lower edge of the nozzle-shaped projection 7 is nearly at the level of the upper side of the container, the container may practically be filled up to the top side thereof without bulk material escaping from the pouring spout 36 when opening the pouring spout 36. Reclosure of the pouring spout is only necessary if the bulk material is to be protected.

After completely emptying the packing, the consumer tears off the perforation line 33 in the first wide side. Then the second top flap 25 and thereupon the first an third top flaps 24 and 26 as well as the fourth top flap 27 may be folded up. This clears the access to the inner bag and the consumer can remove the inner bag from the folding box carton. An auxiliary cut 44 facilitate the removal of the pouring spout 36 from the triangular carton section 16. Thereupon the folding-box carton as a paper product can be disposed separately from the inner bag as plastic product. Hence, neither the paper waste is polluted with plastic nor the plastic waste is polluted with paper. If only the last bottom flap 8 or 10 is glued onto the underlying bottom flaps 7 or 9, the inner bag may easily be pulled out of the bottom anchor thereof.

According to another embodiment of the inventive packing the triangular carton section 16 is free rather than connected with the first narrow side 2 at the folding line 15. This embodiment provides the advantage that the pouring spout may be pushed back far into the interior of the folding-box carton. It is thereby ensured that the pouring spout can be properly accomodated in the interior of the folding-box carton. Moreover this embodiment provides the advantage that the folding-box carton and the inner bag can be manufactured separately when producing the packing, they can eventually be filled when separated and are finally combined, which may facilitate the manufacture. In this case the pouring spout 36 is pulled out to such an extend that one corner of the triangular carton portion 16, preferably the lowermost corner, locks behind the folding-box carton, whereby it is as well ensured that the pouring spout is prevented from slipping back into the folding-box carton. In the same manner as int he first described embodiment the pouring spout is directed upwardly in an inclined manner so that a practical pouring operation is enabled.

According to a further embodiment not a pyramidal corner portion having a trilateral basis is separated, but a portion in the center of an upper edge of a narrow side. In this case the perforation liens at the top side as well as those at the corresponding narrow side have rectangular form. The pouring spout is passed through a rectangular carton portion which maybe foldable around a folding line or formed freely and separately from the folding-box carton.

I claim:

1. A stackable container for bulk material comprising an outer folding-box carton providing mechanical rigidity and a tight inner bag located within the folding-box carton for receiving the bulk material, the carton having a removable portion, the inner bag comprising a pouring spout having a nozzle-shaped projection and being located behind the removable portion of the folding-box carton, an opening providing access to the pouring spout being located in the folding-box carton after removing the removable portion, wherein the removable portion of the folding-box carton is located at an upper corner, and whrein the folding-box carton has overlapping bottom flaps at the bottom thereof for closing the bottom, the inner bag lying loosely within the folding-box carton, and an ear of the inner bag being held between the overlapping bottom flaps in a closed state of the container.

2. A stackable packing for bulk material comprising an outer folding-box carton providing mechanical rigidity and a tight inner bag located within the folding-box carton for receiving the bulk material, the carton having a removable portion, the inner bag comprising a pouring spout having a nozzle-shaped projection and being located behind the removable portion of the folding-box carton, an opening providing access to the pouring spout being located in the folding-box carton after removing the removable portion, wherein the removable portion of the folding-box carton is located at an upper edge, and wherein the folding-box carton has overlapping bottom flaps at the bottom thereof for closing the bottom, the inner bag lying loosely within the folding-box carton, and an ear of the inner bag being held between the overlapping bottom flaps in a closed state of the container.

3. A container according to claim 1 or 2, wherein the pouring spout can be pulled out of the folding-box carton a certain distance after removing the removable portion.

4. A container according to claim 1 or 2, wherein a lower edge of the nozzle-shaped projection after pulling out the same projects beyond the face of the folding-box carton through which it is pulled.

5. A container according to claim 1 or 2 wherein the removable portion is connected with the folding-box carbon by a perforated line.

6. A container according to claim 1 wherein the folding-box carton has a substantially prismatic form from which an upper corner portion can be removed from the folding-box carton.

7. A container according to claim 1 or 2 wherein the nozzle-shaped projection comprises a flange which is tightly connected with the inner bag.

8. A container according to claim 7 wherein the nozzle-shaped projection comprises an extension that extends in direction of the flange and locks behind a first edge portion of the opening after the nozzle-shaped projection is pulled out.

9. A container according to claim 1 or 2 wherein the folding-box carton comprises a flap which is foldable connected with a second edge portion of the opening, the nozzle-shaped projection being passed through the flap for use.

10. A container according to claim 1 or 2 wherein the nozzle-shaped projection extends through a carton portion which is shaped to substantially correspond to the opening produced by removing the removable portion, and that the carton portion locks behind an edge of the pouring spout, preferably a lower edge, when pulling out the pouring spout.

11. A container to claim 1 or 2 wherein the folding-box carton comprises a perforated lien which allows opening of the folding-box carton and removal of the inner bag after tearing off the removable portion at the perforated line.

* * * * *